US005472350A

United States Patent [19]

Mehta

[11] Patent Number: 5,472,350

[45] Date of Patent: Dec. 5, 1995

[54] ELECTRICAL RECEPTACLE AND TERMINALS

[75] Inventor: Parag J. Mehta, Copaigue, N.Y.

[73] Assignee: Pass & Seymour, Inc., Syracuse, N.Y.

[21] Appl. No.: 181,042

[22] Filed: Jan. 14, 1994

[51] Int. Cl.[6] ..... H01R 19/28

[52] U.S. Cl. ..... 439/107

[58] Field of Search ..... 439/106, 107, 439/650; 29/879

[56] References Cited

U.S. PATENT DOCUMENTS

| | | | |
|---|---|---|---|
| 3,443,542 | 5/1969 | Klumpp et al. | 29/879 |
| 3,868,161 | 2/1975 | Frantz | 439/650 X |
| 4,172,628 | 10/1979 | Lingaraju | 439/650 X |
| 4,854,885 | 8/1989 | Bowden et al. | 439/107 |

*Primary Examiner*—Gary F. Paumen
*Assistant Examiner*—Jill DeMello
*Attorney, Agent, or Firm*—Charles S. McGuire

[57] ABSTRACT

A duplex receptacle consisting of molded plastic base and cover portions, a pair of terminals having female contacts for receiving plug blades, and a mounting strap. The terminals are formed with a minimum of bending operations from blanks cut in succession from a metal strip in a manner minimizing the distance of die progression per blank, and reducing scrap. The contacts have a configuration which enhances electrical communication with the inserted plug blades. Portions of the cover cooperate with the contacts to increase blade retention force. A portion of the mounting strap is exposed through an opening in the cover to provide further advantages. The spring arms on the terminals include structure which inhibits dislodgement of conductors connected to the receptacle by push-wire terminations.

49 Claims, 6 Drawing Sheets

ELECTRICAL RECEPTACLE AND TERMINALS

BACKGROUND OF THE INVENTION

The present invention relates to wiring devices, and more particularly to novel and improved electrical receptacles having terminals for receiving the blades of conventional plugs.

The prior art is replete with variations in the design of the common receptacle which is connected to a source of AC power in the wiring system of a house or other building structure. Although such receptacles may be mounted in virtually any desired location or environment, they are most familiar as household devices commonly termed wall outlets or receptacles. An appliance, or other item requiring AC power is connected to the power source by male blades, usually extending from a plug at the end of a cord, which are inserted in female contacts within the receptacle.

Building codes in many localities require the use of wall outlets, as well as other wiring devices, which conform to certain standards prescribed by agencies or associations such as UL and NEMA. Therefore, it is not surprising that the wall outlets of different manufacturers have many features in common. Countless variations are possible, however, while remaining within the prescribed guidelines, and efforts to improve and simplify such devices continue.

In the most general terms, it is the object of the present invention to provide a wiring device in the nature of a wall outlet which conforms to all presently required standards while having improved structural features contributing to both enhanced operating characteristics and economy of manufacture.

Additional, more specific objects are to provide a wall outlet:

having terminals including female contacts which are configured to enhance good electrical communication with male blades inserted into such contacts throughout travel of the blades into and out of the contacts, including terminals with spring contacts for push-wire terminations with improved wire-retention characteristics, having a base, cover, mounting strap and terminals with structural features and positional relationships of the elements, particularly the cover and strap, permitting conformity to required parameters while simplifying and economizing manufacture, wherein the cover includes integral portions cooperatively positioned with respect to portions of the female contacts to enhance the blade-retaining capabilities thereof, having terminals formed from sheet metal blanks in a manner minimizing the distance of progression between successive blanks, and reducing scrap, and having terminals, including blade-receiving contacts, of improved design permitting elimination of bending steps, as compared to prior art terminals of this type, in forming the terminals from precut blanks.

Other objects will in part be obvious and will in part appear hereinafter.

SUMMARY OF THE INVENTION

The aforementioned objects are achieved in a disclosed, preferred embodiment of a duplex wall outlet configured for mounting in a standard junction box and covered by a conventional wall plate. The duplex receptacle is designed to comply with all current NEMA and UL specifications, thus having many features in common with other commercial receptacles. For example, receptacles of the prior art and of the present invention include a base and a cover of molded plastic which fit together to define internal cavities which hold portions of a pair of terminals and a mounting strap. Hot and neutral lines of the wiring system wherein the receptacle is included are respectively connected to the two terminals and a ground line is connected to the mounting strap. The cover includes two sets of openings for receiving the blades of standard plugs connected to the receptacle.

The mounting strap is of the type extending straight through the cover and base, between the outwardly extending parts at each end through which the mounting screws extend. The only bends in the strap are to form the tab at the side, adjacent one end, having a tapped opening for the screw which retains the ground line when such is utilized. The cover has an opening to expose a central portion of the strap which includes a tapped opening for the wall plate mounting screw. As will be explained later, this unique arrangement permits the use of this advantageous form of strap while complying with both NEMA and UL dimensional standards.

The terminals are formed by appropriately bending blanks cut from a strip of electrically conductive sheet metal. The blanks are designed with parts overlapping adjacent blanks to minimize the distance of progression between successive blanks, and to reduce scrap. Also, the terminals are designed to minimize the number of bends necessary to provide the final configuration, and to ensure good contact with the plug blades throughout movement thereof when being inserted into and withdrawn from the female contacts of the terminals.

The terminals are provided with both screw and push-wire termination means for the connection of electrical lines to the receptacle. The push-wire terminations include the usual spring arms which urge the end of a bare wire inserted through an opening in the back of the base into firm engagement with a stationary part of the terminal. In the terminals of the present invention, the spring arms are formed with an outward projection at each side to inhibit dislodgement of the wire retained thereby.

An additional feature of the receptacle is the provision of a plurality of semi-rigid posts extending integrally from the inner side of the cover into the cavities where the female, blade-receiving, terminal contacts are positioned. The posts are cooperatively positioned with respect to the portions of the contacts which are moved outwardly as the blades are inserted so that such portions contact the posts and are inhibited from free, outward movement. This arrangement enhances the blade-retaining capability of the receptacle.

The features of the receptacle summarized above will be more fully understood and appreciated from the following detailed description of the preferred embodiment, taken in conjunction with the accompanying drawings, wherein:

DETAILED DESCRIPTION

Figure 1:
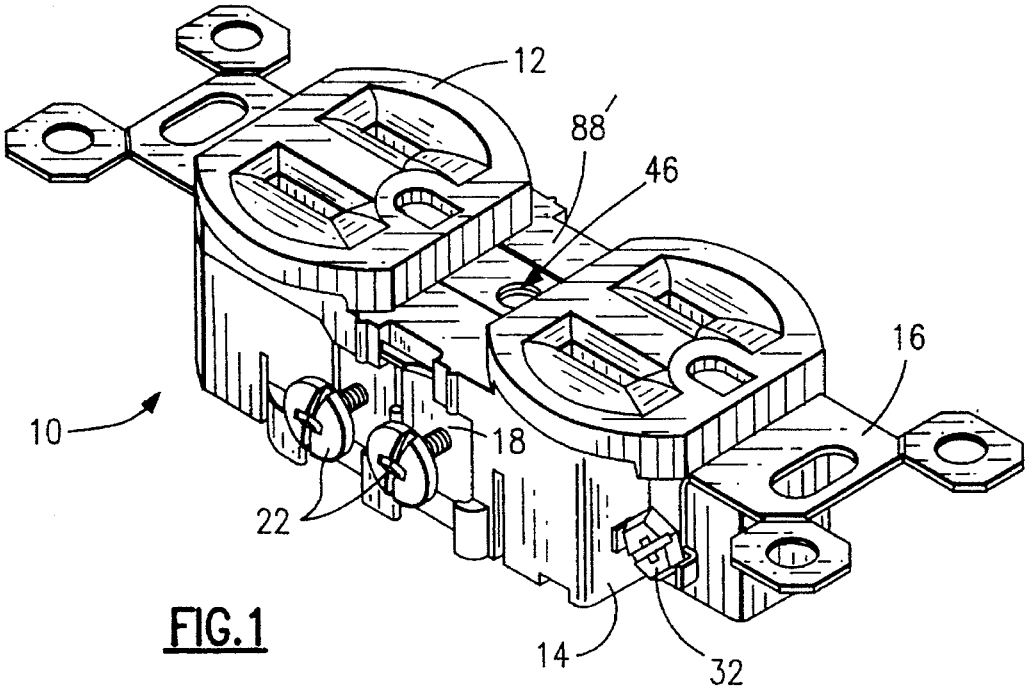
FIG. 1 is a perspective view of the receptacle in fully assembled condition.
Figure 2:
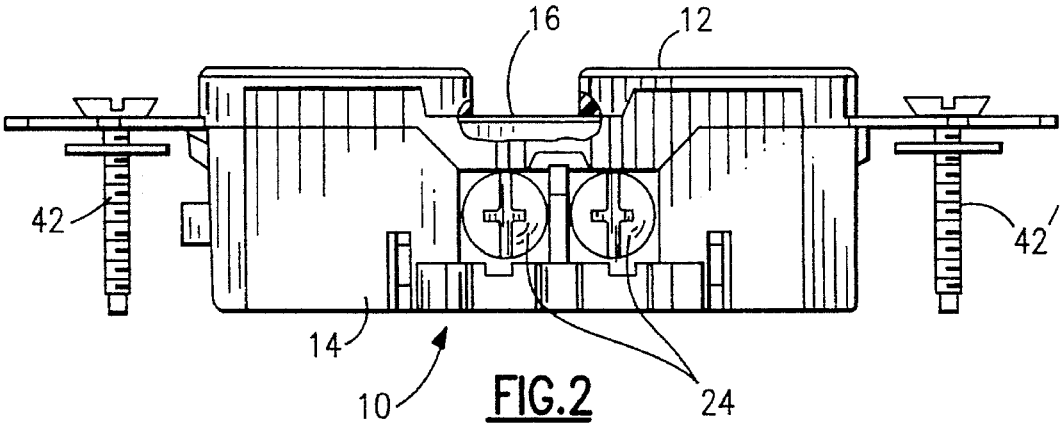
FIG. 2 is a side elevational view of the assembled receptacle, with portions broken away.

Referring now to the drawings, in FIGS. 1 and 2 is shown an assembled duplex receptacle, denoted generally by reference numeral 10, embodying the features of the present invention. Receptacle 10 includes cover 12 and base 14, each formed as a unitary, molded part of a dielectric material such as a suitable plastic, and strap 16. Receptacle 10 further includes a pair of terminals 18 and 20, exteriorly exposed portions of which are seen in FIGS. 1 and 2, both terminals being shown in their entireties in the exploded perspective view of FIG. 3. Respective pairs of screws 22 and 24 engage threaded openings in terminals 18 and 20 for securing the stripped ends of electrical wires thereto.

As will be apparent from the exploded perspective view (FIG. 3), receptacle 10 consists essentially of the aforementioned five elements, i.e., cover 12, base 14, strap 16 and two terminals 18 and 20. Details of construction of the cover, base and terminals are shown and described in connection with later drawing Figures. Mounting and grounding strap 16 is shown in its entirety only in FIG. 3, and portions thereof are visible in FIGS. 1 and 2. Strap 16 is formed from a blank of galvanized steel or other appropriate sheet metal having a thickness of substantially 0.040" to comply with certain dimensional requirements of both NEMA and UL codes, as explained later in more detail.

Strap 16 is essentially flat, having opposite, planar surfaces, with no bends other than the ones necessary to form depending tab 26 and small tabs 28 extending outwardly therefrom. Threaded opening 30 (FIG. 3) in tab 26 receives screw 32 (FIG. 1) for the purpose of securing a ground wire (not shown) to the strap in appropriate installations. Ear portions 34, 34', having respective openings 36 36', extend from opposite ends of intermediate portion 38 of strap 16. In the assembled condition of receptacle 10, intermediate portion 38 extends through a cavity between cover 12 and base 14, as described later in more detail, with ear portions 34, 34' extending outwardly from opposite ends of the receptacle.

Figure 3:
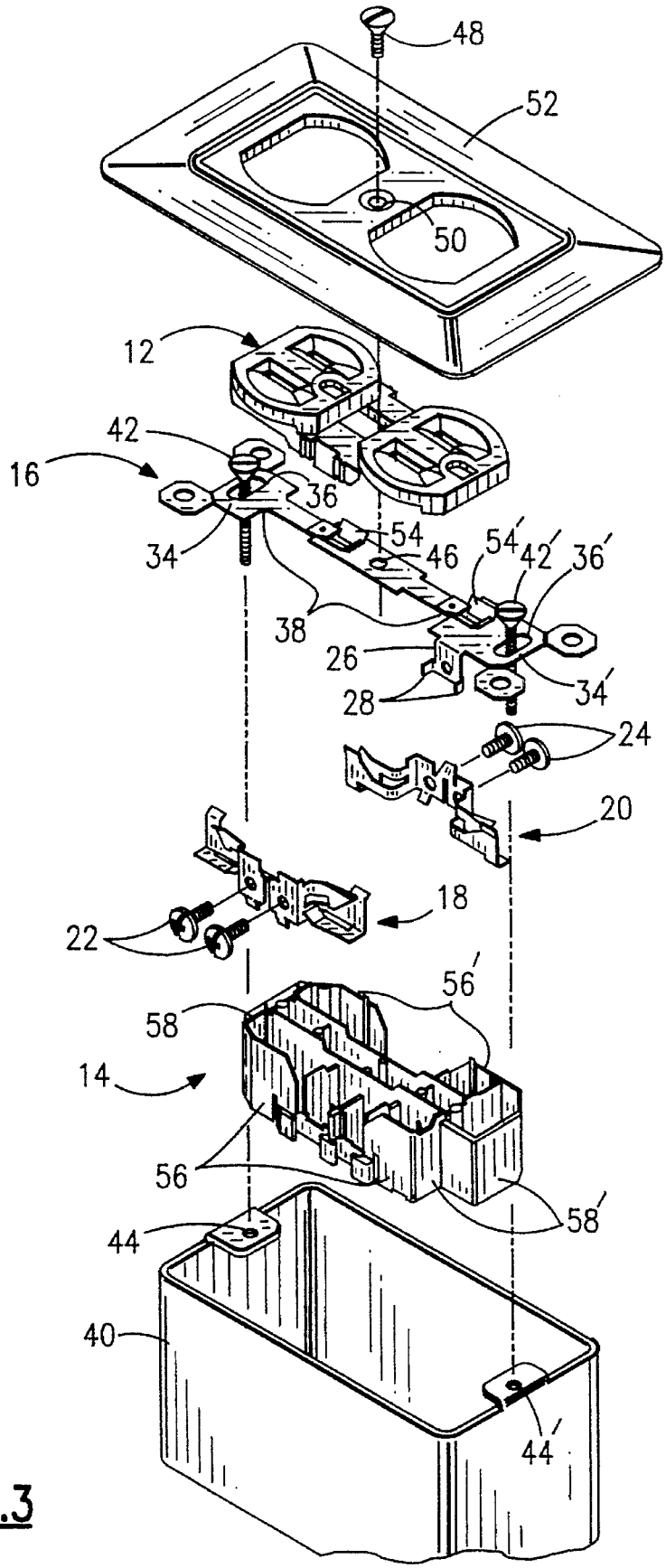
FIG. 3 is an exploded perspective view of the components of to the receptacle, together with a junction box and wall plate employed with the receptacle.

As indicated in FIG. 3, receptacle 10 is mounted in the usual manner in a standard utility box 40 by means of screws 42, 42' passing through openings 36, 36' and received in threaded openings 44, 44' in box 40. Strap 16 further includes a centrally located, threaded opening 46 for receiving screw 48 which passes through opening 50 in conventional wall plate 52 which is provided in the usual manner to cover portions of the installed receptacle. Grounding contacts 54, 54' are riveted to strap 16 and include resilient contacts extending through respective openings in strap 16 to receive the ground prongs of electrical plugs connected to receptacle 10.

Figure 4:
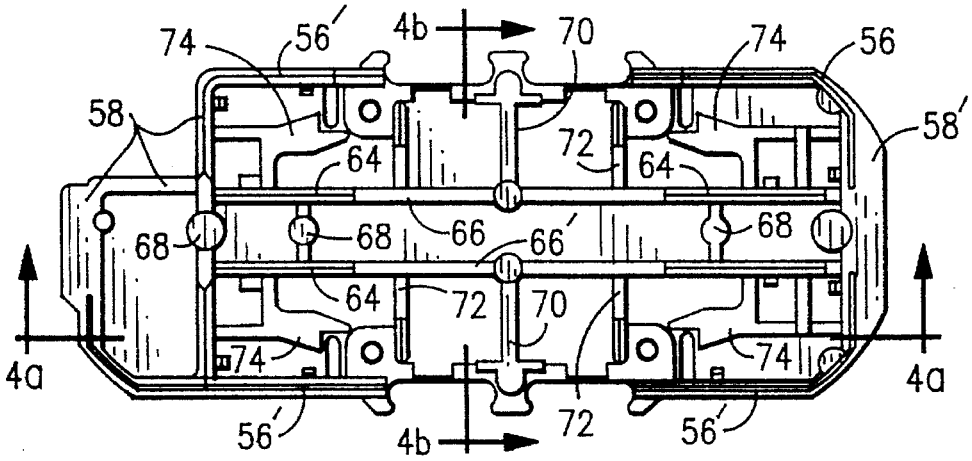
FIGS. 4 and 5 are front and rear elevational views, respectively, of the receptacle base.
Figure 5:
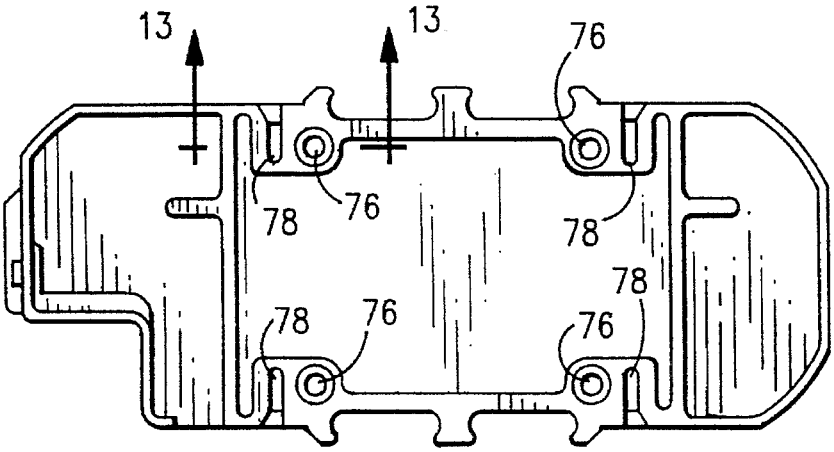
Figure 4A:
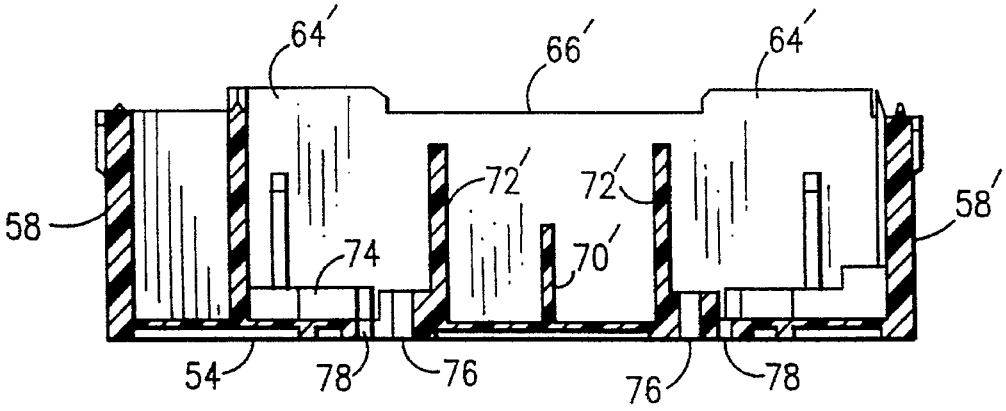
FIGS. 4A and 4B are elevational views in section on the lines 4A—4A and 4B—4B, respectively, of FIG. 4.

Referring now to FIGS. 4 and 5, as well as to FIG. 3, the configuration of base 14 will be described in greater detail. Base 14 includes rear wall 54, opposite side walls 56, 56' and opposite end walls 58, 58'. Side walls 56, 56' are seen to be discontinuous, providing open spaces at the center through which the screw-receiving portions of terminals 18 and 20 are exposed. The outwardly-facing surfaces of walls 54, 56, 56' and 58, 58' define the exterior of base 14, and the inwardly-facing surfaces define a cavity, open at the top (front) and closed by cover 12 in the assembled condition of receptacle 10, the cover and base meeting in permanently bonded relation along the line indicated by reference numeral 60 in FIG. 2.

A plurality of internal wall means are provided within the cavity formed by the peripheral walls of base 14. A pair of spaced, parallel walls 62, 62' (FIG. 3) extend longitudinally of the cavity, from rear wall 54 to terminal edges. Wall 62 has terminal edge portions 64 extending from opposite ends of the wall toward the center and separated by intermediate edge portion 66; likewise, wall 62' has edge portions 64' separated by intermediate edge portion 66'. It will be noted that edge portions 64 and 64' lie in a plane higher (i.e., farther from rear wall 54) than intermediate portions 66 and 66'. A plurality of wall means 68 extend laterally between walls 62, 62', and all terminate in the plane of edges 66 and 66'.

Wall means 70, 70' extend laterally from walls 62, 62', respectively, to the spaces between opposite side walls 56, 56'. A pair of identical wall means, both denoted by reference numeral 72, extend laterally from wall 62, on opposite sides of and equally spaced from wall means 70; a second pair of wall means 72' extend laterally from wall 62' of opposite sides of wall means 70'. Four pedestals 74 are provided at essentially the corners of the cavity, extending from the inner surface of rear wall 54. Four round openings 76 extend through rear wall 54, and four open slots 78 are positioned respectively adjacent openings 76, for purposes explained later.

Figure 6:
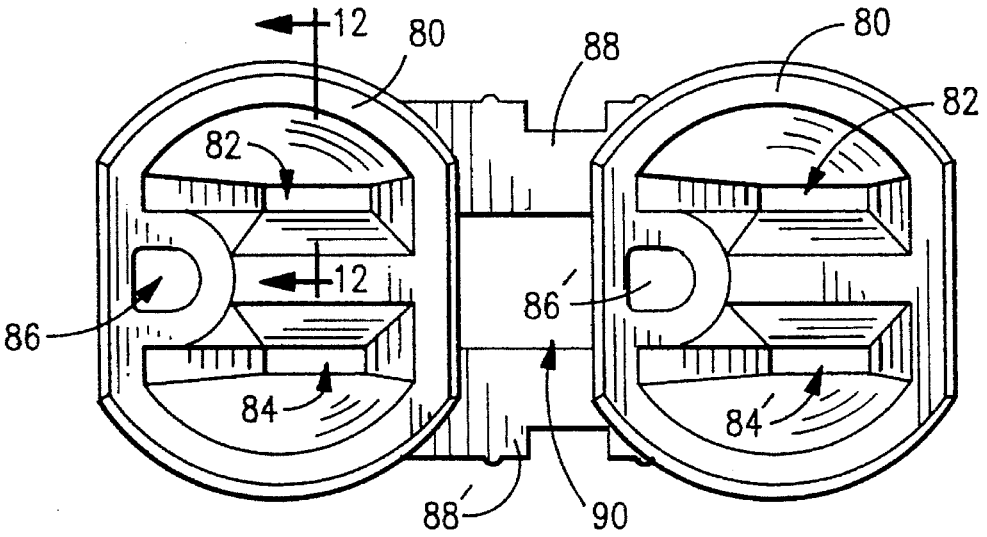
FIGS. 6 and 7 are front and rear elevational views, respectively, of the receptacle cover.
Figure 7:
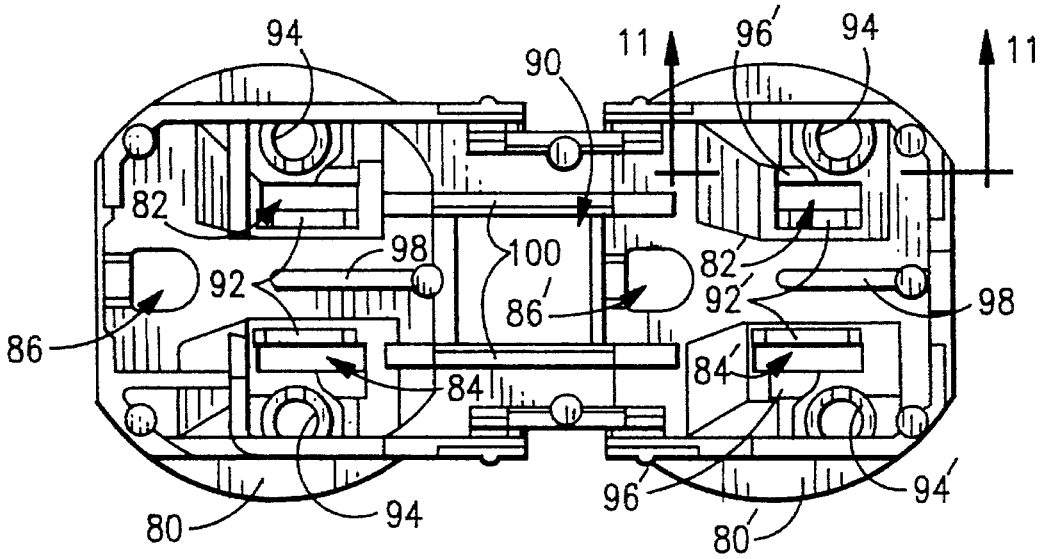
Figure 11:
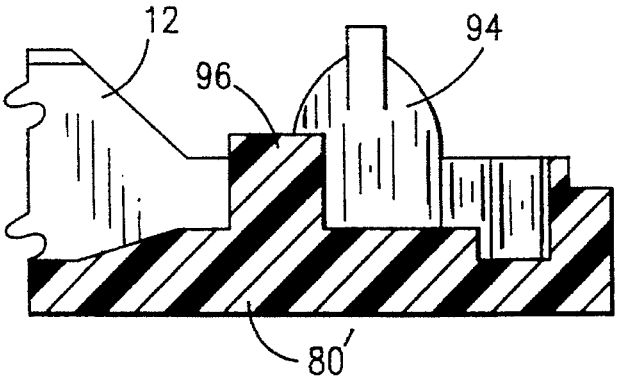
FIG. 11 is an enlarged, fragmentary, elevational view, in section on the line 11—11, of FIG. 7.

Details of cover 12 are shown in FIGS. 6 and 7, as well as in certain sectional views. As in the usual duplex receptacle, the outwardly facing side of cover 12 includes a pair of identical, plug-receiving portions 80, 80', each having first (82, 82') and second (84, 84') elongated, through openings for receiving flat blades or prongs of an electrical plug, and D-shaped, through openings 86, 86' for receiving plug grounding prongs. In the receptacle of the present invention, portions 80 and 80' are connected to one another by bridging portions 88 and 88' with rectangular opening 90 bounded on its ends by plug-receiving portions 80, 80' and on its sides by bridging portions 88, 88'.

Ribs 92 extend from the inner surface of cover 12 adjacent each of elongated openings 82, 82', 84 and 84', each rib having a surface flush with one side of its respective opening. Posts 94 extend from the inner surface of cover 12 on the opposite sides of openings 82, 82', 84 and 84' from ribs 92, the posts being spaced somewhat from the side is of the openings nearest thereto. Relatively short ribs 96 extend along portions of openings 82 82', 84 and 84' on the same sides as posts 94, and a surface of each of ribs 96 is flush with the side of the opening opposite ribs 92. Wall means 98 extend longitudinally of the inner surface of cover 12, midway between openings 82, 84 and 82', 84'. Wall means 100 extend from the inner surface of the cover, bounding opposite sides of opening 90.

Figure 8:
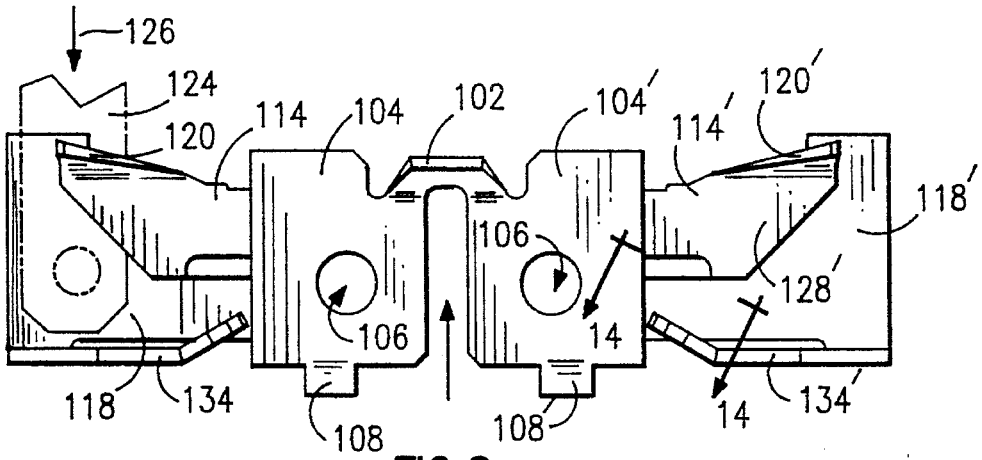
FIGS. 8 and 9 are side elevational views, taken from opposite sides, of one of the two, identical, receptacle terminals.
Figure 9:
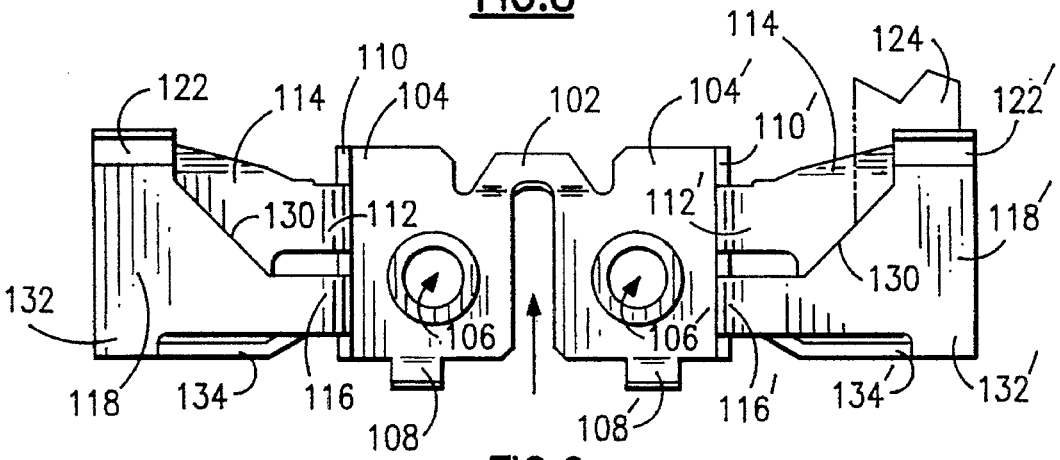
Figure 10:
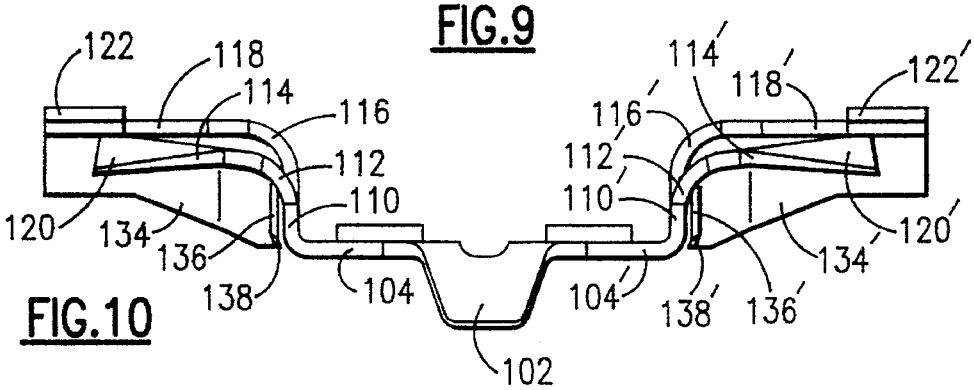
FIG. 10 is a top plan view of the terminal of FIGS. 8 and 9.

One of the two identical terminals 18 and 20 is shown in detail in FIGS. 8–10, with portions shown in other, fragmentary, sectional views. As discussed later in more detail, the terminals are formed from successive blanks cut from a flat sheet of metal and bent to the final configuration. Each terminal includes two identical halves, connected by bridging portion 102. On each side of the bridging portion are first wall portions 104, 104', having tapped openings 106, 106' for receiving wire termination screws 22 and 24. Tabs 108, 108' extend from the lower edges of first wall portions 104, 104' for the purpose of mating with notches in base 14 when the terminals are assembled therewith.

First wall portions 104, 104' are bent at substantially 90°, as indicated at 110, 110' and connected by first, resilient arms 112, 112' to second wall portions 114, 114'. First wall portions 104,104' are further connected by second, resilient arms 116, 116' to third wall portions 118,118'. End portions 120, 120' of second wall portions 114, 114' and end portions 122, 122' of third wall portions 118, 118' are flared outwardly with respect to one another. Aside from flared end portions 120, 120', 122 and 122', the inner and outer surfaces of all of wall portions 104, 104', 114, 114', 118 and 118' are planar, the wall surfaces seen in FIGS. 8 and 9 being termed outer and inner surfaces, respectively. The outer surfaces of first wall portions 104, 104' are the only externally exposed portions of terminals 18 and 20 in the assembled condition of receptacle 10.

Flared end portions 120, 120' and 122, 122' provide entry means for blade 124 of an electrical plug inserted linearly in the direction of arrow 126 through one of the elongated openings 82, 82', 84 and 84' for engagement of opposite blade surfaces between the contacts provided by second and third wall portions 114 and 118 or 114' and 118'. Edges 128, 128' of second wall portions 114, 114' are at an acute angle, preferably about 45°, to plug insertion direction 126, as are edges 130, 130' of third wall portions 118, 118'. As best seen in FIG. 10, arms 112 and 116 are bent or curved, the bend in arm 112 being closer to wall 104 than the bend in arm 116. The bend in arm 116 is substantially 90°, whereby the inner and outer surfaces of wall 118 are essentially parallel to those of wall 104. The bend in arm 112 is less than 90°, whereby the surfaces of wall 114 are at an acute angle, preferably between about 5° and 10°, to the surfaces of wall 118. The relative positions and the degree of curvature of the bends in arms 112 and 116 results in some amount of overlapping of walls 114 and 118 with the inner surface of wall 114 contacting the outer surface of wall 118 essentially along the line of free edge 128. Thus, opposite surfaces of blade 1.24 are contacted by the outer surface of wall 118 and by free edge 128 of wall 114 during essentially the full range of travel of the blade between the terminal contacts, thereby providing excellent electrical communication.

Figure 4B:
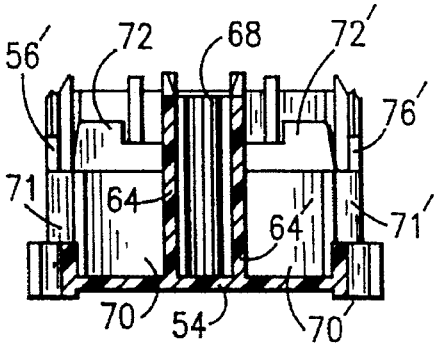
Figure 12:
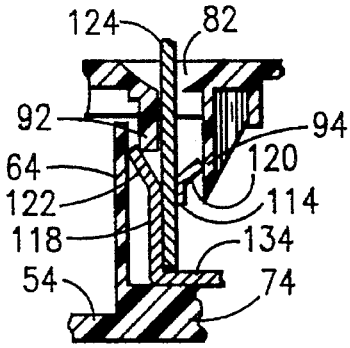
FIG. 12 is a fragmentary, elevational view, in section on the line 12—12 of FIG. 6 which includes, in addition to portions of the cover, portions of the base and one of the terminals with a plug blade positioned between the contacts.

The relative positions of certain portions of the cover, base and terminals, in the assembled condition of receptacle 10 and with plug blade 124 inserted, are shown in the fragmentary, sectional view of FIG. 12. Terminals 18 and 20 are placed within the cavities formed by previously described wall portions of base 14. When so positioned, outer portions 71, 71' (FIG. 4B) of walls 70, 70' extend into gaps 101 in FIGS. 8, 9) between the two halves of the terminals, end portions 122, 122' of terminal walls 118, 118' essentially abut base wall, portions 64, 64' and lower portions 134, 134' of the terminals rest upon base pedestals 74. After placing strap 16 upon the base, with intermediate portion 38 supported by base wall portions 68, cover 12 is placed on the base with opposing edge portions meeting along line 60 (FIG. 2), and the cover and base are permanently joined by ultrasonic welding.

When cover 12 and base 14 are joined, wall portion 92 on the inside of the cover extends to a position directly above end portion 122 of terminal wall 118, essentially fixing the position of terminal wall 118. Terminal wall 114, of which only a small fragment is seen in FIG. 12 due to the position at which the section is taken, is movable by blade 124 away from wall 118. When blade 124 is inserted, flared end portion 120 is moved into contact with post 94. Although end portion 120 and post 94 have some degree of resilience, both are relatively stiff and the constraint of movement of terminal wall portion 114 by post 94 provides a higher degree of holding force on the plug blade than would be available only from the biasing force of arm 112 on the moveable contact (wall 114). This feature, coupled with the previously described line contact of edge 128 with the surface of the plug blade, ensures both good electrical communication and blade retention.

The component parts of receptacle 10 are suited for expeditious assembly, by fully automated means, if desired, simply by sliding terminals 18 and 20 .into the pockets provided by the wall means within base 14, placing strap 16 on supporting wall means 68 of the base, and placing cover 12 with its edges in mating engagement with edge portions of base 14. Referring again to FIG. 2, it will be seen that the distance between the plane of the upper or front surfaces of cover bridging portions 88, 88' and line 60, where the cover and base are joined, is indicated as dimension D. Current NEMA standards require that dimension D have a maximum of 0.040", while UL standards required that the strap have a minimum thickness of 0.040". Thus, by making both dimension D and the thickness of strap 16 equal to 0.040", both standards are met in a receptacle having a flat strap, extending straight through the receptacle with no bends.

Third wall portions 118, 118' are connected at 132, 132' to spring arms 134, 134' which provide so-called "push wire" connection of electrical conductors to the terminals. Spring arms 134, 134' are narrower at their connections to third wall portions 118, 118' than at their free ends, which terminate in linear edges 136, 136' with protrusions 138, 138' at each end thereof. The configuration of spring arms 134, 134' is such that the free ends are in contact with or close proximity to surfaces of the terminal formed by portions 110, 110' and arms 116, 116'.

Figure 13:
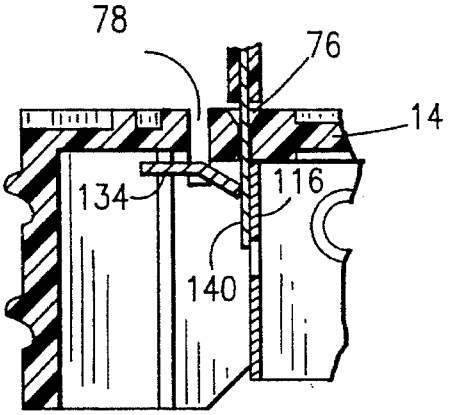
FIG. 13 is a fragmentary, elevational view taken on the line 13—13 of FIG. 5, showing-portions of the receptacle contacts with the end of a conductor inserted therein to effect a push-wire termination.
Figure 14:
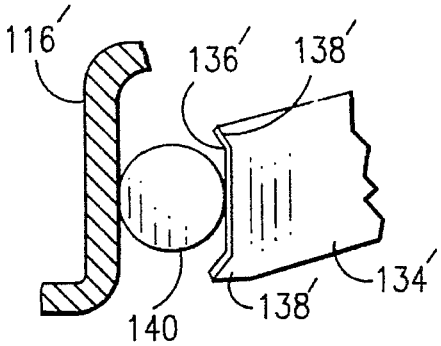
FIG. 14 is an enlarged, fragmentary, elevational view as seen from the line 14—14 of FIG. 8, showing the inserted electrical wire of FIG. 13 engaged between two portions of the terminal.

In the assembled form of receptacle 10, the axes of the passageways through base 14 provided by openings 76 intersect spring arms 134, 134' at or near their free ends. Thus, the end of an electrical conductor stripped of insulation may be axially inserted through one of openings 76 and will move the free end of spring arm 134, 134' away from the adjacent wall of the terminal. As shown in FIGS. 13 and 14, conductor 140 is engaged between terminal edge 136' and the facing surface of arm 116', thus being in electrical communication with the terminal. Protrusion 138' inhibits dislodgement of conductor 140 by lateral movement in the direction of wall 56' of base 14 . Conductor 140 may be released from engagement by insertion of an appropriate tool through the adjacent slot 78 to temporarily deflect the spring arm away from the conductor.

Figure 15:
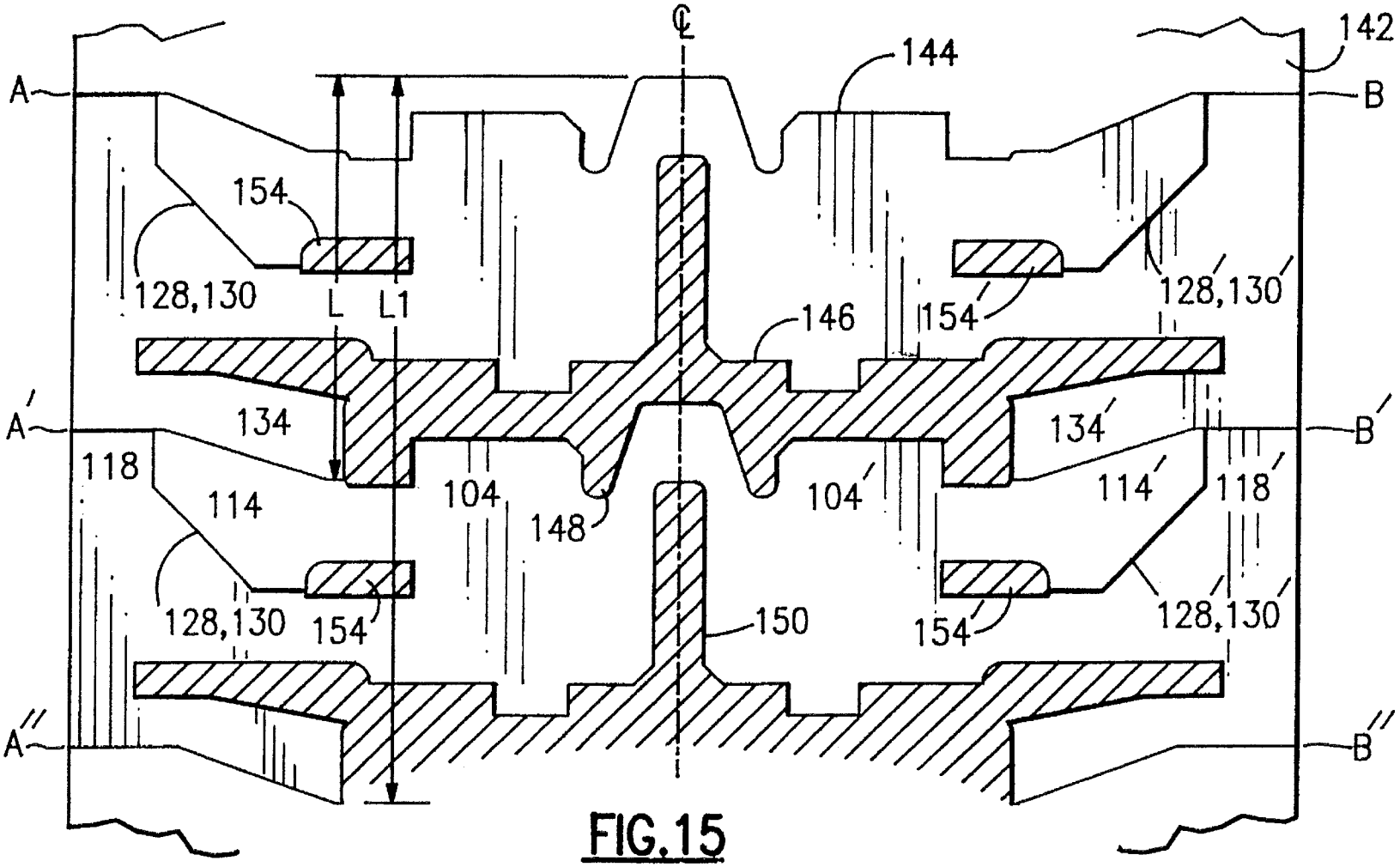
FIG. 15 is a plan view of a strip of sheet metal showing a succession of blanks from which the receptacle terminals are formed laid out thereon.

As previously mentioned, the terminals are formed from blanks cut by a conventional die (not shown) successively from a flat strip of copper or other appropriate metal. The layouts of two successive blanks on strip 142 are shown in FIG. 15. Portions of the strip which are used to form the terminals are shown with conventional surface shading, while portions which become scrap are cross-hatched. The blank layout permits overlapping of portions of successive blanks, thereby reducing both the amount of scrap and the distance of progression through the die between successive blanks. More specifically, the portions of the blanks which become spring arms 134, 134' of one terminal are laterally adjacent portions which become the wall portions 104, 104', 114 114', 118 and 118', as well as bridge portions 102 of another terminal. As is apparent, the side edges of the blank layouts are coextensive with the side edges of strip 142.

Each blank layout has non-linear top and bottom edges extending continuously between the side edges. Top edge 144 of the first (upper) blank layout of FIG. 15 extends between points A and B. Bottom edge 146 of the first blank layout and top edge 148 of the second (lower) blank layout each extend between points A' and B'. Bottom edge 150 of the second blank layout extends between points A" and B". Each blank layout is symmetrical on opposite sides of the indicated centerline, i.e., the two halves of each blank layout are mirror images of one another. Each blank layout has an overall length L (measured in a direction parallel to the side edges) between the farthest spaced points on the top and bottom edges. Due to the overlapping of the blank layouts, the overall length $L_1$ of two successive blank layouts is less than twice the overall length L of a single blank layout; in the preferred successive blank layouts of the present invention $L_1$ is approximately 1.85L.

It will be noted that the bottom edge of one blank layout and the top edge of the next blank layout (e.g., edges 146 and 148) have first and second, coextensive portions extending inwardly from the side edges. In FIG. 15, edges 146 and 148 are coextensive between points A' and C, as well as between points B' and C'. Over third portions of their respective lengths, between points C and C', edges 146 and 148 are not coextensive and define a unitary scrap portion 152. The only other scrap portions associated with each blank layout are relatively small, identical portions 154, 154'. It will be further noted that a single line in each half of the blank layouts becomes overlapped edges 128 and 130 of the two contact portions in the finished terminal, being indicated by these reference numerals in FIG. 15.

From the foregoing, it may be seen that receptacle 10 has a number of features which achieve the objects and advantages previously enumerated. The strap may be flat, with no bends other than those forming the tab for attachment of a ground wire, while still providing a receptacle complying with all current NEMA and UL standards. The terminals, both in themselves and in conjunction with other parts of the receptacle, provide enhanced blade contact and retention, as well as improved spring arms for push-wire terminations. The terminals are economically formed with a minimum of bending operations from blanks cut successively from a metal strip with minimized die progression and scrap.

What is claimed is:

1. An electrical terminal having female contacts for sliding insertion and withdrawal along a predetermined, linear path of a plug blade having opposite, flat surfaces, said terminal comprising:

a) a first wall portion having first, inner and outer surfaces;

b) means for connecting an electrical conductor in conducting contact with a predetermined, planar part of said first wall portion;

c) a second wall portion having second, inner and outer surfaces;

d) a first, resilient arm integrally connecting said first and second wall portions;

e) a third wall portion having third, inner and outer surfaces;

f) a second, resilient arm integrally connecting said first and third wall portions;

g) said second and third wall portions being inwardly offset by said first and second arms from said first wall portion in a direction transverse to the plane of said planar part;

h) said second and third wall portions being positioned with said second inner surface contacting said third outer surface along a free edge of said second wall portion remote from said first arm; and i) blade entry means defined by flared end portions extending outwardly from said second outer and said third inner surfaces for insertion therebetween of said plug blade along said linear path as at least one of said first and second arms is flexed to permit separation of said free edge from said third outer surface with said opposite surfaces of said blade respectively contacting said free edge and said third outer surface, said free edge being substantially linear and disposed at an acute angle with respect to said linear direction.

2. The invention according to claim 1 wherein said angle is about 45°.

3. The invention according to claim 1 wherein said first wall portion is bent inwardly at a first angle with respect to said planar part, and both said first and second arms are curved outwardly.

4. The invention according to claim 3 wherein said first angle is substantially 90°.

5. The invention according to claim 4 wherein said second arm is curved about 90°, and said third wall surfaces are planar and substantially parallel to the plane of said planar part of said first wall portion.

6. An electrical terminal having female contacts for sliding insertion and withdrawal along a predetermined, linear path of a plug blade having opposite, flat surfaces, said terminal comprising:

a) a first wall portion having first, inner and outer surfaces;

b) means for connecting an electrical conductor in conducting contact with a predetermined, planar part of said first wall portion;

c) a second wall portion having second, inner and outer surfaces;

d) a first, resilient arm integrally connecting said first and second wall portions;

e) a third wall portion having third, inner and outer surfaces;

f) a second, resilient arm integrally connecting said first and third wall portions;

g) said second and third wall portions being inwardly offset by said first and second arms from said first wall portion in a direction transverse to the plane of said planar part;

h) said second and third wall portions being positioned with said second inner surface contacting said third outer surface along a free edge of said second wall portion remote from said first arm; and i) blade entry means defined by flared end portions extending outwardly from said second outer and said third inner surfaces for insertion therebetween of said plug blade along said linear path as at least one of said first and second arms is flexed to permit separation of a free edge of said second wall portion from said third outer surface with said opposite surfaces of said blade respectively contacting said free edge and said third outer surface, said third inner and outer surfaces lying in parallel planes substantially parallel to said planar part of said first wall portion, and said second inner surface being disposed in a plane at an acute angle to said third outer surface when said free edge is in contact with said third outer surface.

7. The invention according to claim 6 wherein said acute angle is between about 5° and 10°.

8. The invention according to claim 7 wherein said first arm, over at least most of its length, is closer than said second arm to said first wall.

9. The invention according to claim 8 wherein said first and second arms are in spaced, substantially side-by-side relation.

10. An electrical receptacle for placing a pair of plug blades having planar surfaces of predetermined width in electrical communication with a source of AC power, said receptacle comprising:

a) a base portion of dielectric material;

b) a cover portion of dielectric material having a pair of openings through which said blades may be inserted and withdrawn by movement along a predetermined, linear path, said base and cover portions cooperatively defining an internal cavity;

c) a pair of terminals, each including i) means for connection thereto of an electrical conductor;

ii) a first contact strip having first, planar, inner and outer surfaces bounded on one side by a contact edge;

iii) a second contact strip having second, planar, inner and outer surfaces;

iv) first and second support means for said first and second contact strips, respectively, at least: one of said support means being resilient to permit limited, relative movement of said contact strips from an unflexed position, to which said contact strips are biased by said support means, to a flexed position;

v) said contact strips, when in said unflexed position, being supported with said first strip contact edge in essentially linear contact with said second strip outer surface, and said first inner and second outer surfaces disposed in planes extending at an acute angle from said contact edge; and vi) a pair of outwardly flared end portions respectively extending from said first and second contact strips; and d) positioning means for holding said contact strips within said cavity with said end portions of said terminals aligned with a respective one of said pair of openings, whereby insertion of said blades through said openings moves said blades between said contact strips and moves the latter to said flexed position with said first strip contact edge in contact with one and said second strip outer surface in contact with the other of said blade surfaces.

11. The invention according to claim 10 wherein said contact edge is substantially linear,

12. The invention according to claim 11 wherein said edge is disposed at a predetermined angle between about 30° to 60° with respect to said linear path.

13. The invention according to claim 12 wherein said contact edge is in contact over at least about 90% of its entire length with said one of said blade surfaces when said blades are fully inserted.

14. The invention according to claim 12 wherein at least a portion of said contact edge is in contact with said one surface of said blade over the full range of travel of said blade between said first and second contact strips.

15. The invention according to claim 10 wherein said acute angle is between about 5° and 10°.

16. The invention according to claim 10 and further including means positioned within said cavity in the path of movement of one of said contact strips of each of said terminals toward said flexed position thereof.

17. The invention according to claim 16 wherein said means within said cavity extend integrally from said cover portion inwardly of said cavity.

18. The invention according to claim 17 wherein said means within said cavity comprise a pair of post members respectively positioned in the path of movement of one of said contact strips of each of said pair of terminals.

19. The invention according to claim 18 wherein each of said post members extends from said cover portion to a terminal end, and said one contact strip contacts the respective one of said post members adjacent said terminal end when said blade is fully inserted between said contact strips, whereby said post members oppose further movement of said one contact strip toward said flexed position and enhance the retaining force exerted by said contact strips on said blades.

20. The invention according to claim 19 wherein said one contact strip is said first contact strip.

21. The invention according to claim 20 wherein said first support means comprises a resilient arm upon which said first contact strip is supported for movement between said unflexed and flexed positions.

22. An electrical receptacle for connection in an AC circuit to receive a pair of male plug blades, said receptacle comprising:

a) a base portion of dielectric material;

b) a cover portion of dielectric material affixed to said base portion to define therewith an internal cavity and having a pair of openings configured and positioned for insertion and withdrawal therethrough of said plug blades;

c) a pair of terminals each having first and second contact strips with opposed portions forming a pair of female contacts for receiving said plug blades;

d) resilient support means for at least one of said contact strips of each of said terminals, said support means exerting a biasing force tending to move said one contact strip in a direction toward contact of said opposed portions and to resiliently resist movement of said one contact strip in the opposite direction by insertion of said plug blades between said opposed portions; and e) obstruction means having a limited degree of resilience positioned within said cavity in the path of movement in said opposite direction of said one contact strip, insertion of said blades between said opposed portions serving to move said one contact strip of each of said terminals into contact with a respective one of said obstruction means, whereby the latter augments said biasing force and increases the retaining force exerted on said blades by said opposed portions of said contact strips.

23. The invention according to claim 22 wherein said obstruction means comprise a pair of post members.

24. The invention according to claim 23 wherein said post members extend into said cavity integrally from one of said base portion and cover portion.

25. The invention according to claim 24 wherein said post members extend integrally from said cover to terminal ends respectively positioned adjacent said one contact strip of said pair of terminals.

26. The invention according to claim 25 wherein said pair of openings are elongated, parallel and laterally spaced from one another, said cover portion has an inner surface directed toward said cavity, and said post members extend integrally from said inner surface adjacent respective ones of said openings.

27. The invention according to claim 26 wherein said post members are laterally, outwardly adjacent an elongated side of respective ones of said openings.

28. a duplex wall receptacle for connection to an AC power source, said receptacle comprising:

a) a base portion of dielectric material having a rear wall, opposite side walls and opposite end walls, said side and end walls terminating in base edge portions;

b) a cover portion of dielectric material having a front wall with front and back sides and wall means on said back side defining cover edge portions configured for mating engagement with said base edge portions, whereby said base and cover portions cooperatively define an enclosed cavity;

c) said front side of said cover portion including first and second end portions and a central portion, each of said end portions having a plurality of first openings therethrough for passage of the blades of an electrical plug, said end portions having forward surfaces lying in a common, first plane and said central portion having a forward surface lying in a second plane, parallel to said first plane and spaced therefrom in the direction of said base portion;

d) means defining a second opening of predetermined peripheral outline extending through said central portion and between said end portion; and e) a mounting strap having an intermediate portion positioned within and extending through said cavity and ear portions extending outwardly from said opposite end walls, said strap being captured between and held in a fixed position by opposing parts of said base and cover portions with a planar surface of said intermediate portion exposed through said second opening and lying substantially in said second plane.

29. The invention according to claim 28 and further including a threaded opening in said intermediate portion exposed through said second opening for receiving a wall plate mounting screw.

30. The invention according to claim 29 wherein said threaded opening is located substantially centrally of said second opening.

31. The invention according to claim 30 wherein said predetermined outline is substantially rectangular.

32. The invention according to claim 31 wherein said second opening extends longitudinally between said end portions and laterally a distance slightly greater than the width of said intermediate portion of said strap exposed through said second opening.

33. The invention according to claim 28 wherein said intermediate and ear portions of said strap have contiguous, substantially flat and coplanar, opposite surfaces.

34. The invention according to claim 33 wherein said intermediate portion has substantially linear, parallel, side edges.

35. The invention according to claim 34 wherein said intermediate portion of said strap exposed through said second opening has a predetermined, uniform width and said second opening has parallel side edges spaced a few thousandths of an inch greater than said predetermined width.

36. The invention according to claim 35 wherein said strap is of electrically conducting material and includes a pair of third openings aligned with respective ones of each of said plurality of first openings for receiving, in electrical contact, the grounding prongs of plugs connected to said receptacle.

37. The invention according to claim 34 and further including first and second retaining walls within said cavity having opposing, parallel walls spaced a few thousandths of an inch greater than the width of a predetermined length of said intermediate portion of said strap lying between said retaining walls.

38. The invention according to claim 37 wherein said retaining walls are formed integrally with said base portion and lie between and parallel to said opposite side walls.

39. The invention according to claim 38 and further including support means positioned between said first and second retaining walls, one of said opposite surfaces of said predetermined length of said intermediate portion of said strap lying upon said support means.

40. A wiring device for connection to hot and neutral conductors of an AC electrical circuit, said device comprising:

a) housing means defining an enclosed cavity;

b) a terminal of electrically conducting material having a fixed wall and a spring arm positioned within said cavity, said spring arm extending from a resiliently supported end to a free end having a central portion of predetermined width in close proximity to said fixed wall and movable with respect thereto by application of force to said spring arm;

c) a passageway through said housing means having a central axis substantially aligned with central portion of said free end, whereby forcible insertion of an end of an elongated electrical conductor along said axis applies said force to said spring arm, moving said free end away from said fixed wall and engaging said conductor end between said central portion of said free arm and said fixed wall in electrical communication with said terminal; and d) a protrusion extending outwardly from said free end at one side of said central portion, laterally spaced from said central axis and extending toward said fixed wall, whereby said protrusion resists disengagement of said conductor end by lateral movement thereof in the direction of said protrusion.

41. The invention according to claim 40 wherein said central portion comprises an essentially linear edge of said free end.

42. The invention according to claim 41 wherein said protrusion terminates in a linear edge substantially parallel to said central portion linear edge.

43. The invention according to claim 40 wherein said wiring device includes a pair of said terminals, each having a fixed wall and spring arm, and said housing means includes a pair of said passageways having axes respectively aligned with said free ends of said spring arms for connection of a hot conductor to one and a neutral conductor to the other of said pair of terminals.

44. The invention according to claim 43 wherein said terminals each include female contacts for receiving blades of an electrical plug.

45. A succession of identical blank layouts on a flat, elongated metal strip having linear, parallel, side edges for cut-out of successive blanks prior to the forming thereof into electrical terminals of predetermined configuration, said succession of blank layouts comprising:

a) a first blank layout having first side edges coextensive with said side edges of said strip, and first, continuous, non-linear, top and bottom edges extending between said first side edges;

b) a second blank layout having second side edges coextensive with said side edges of said strip, and second, continuous, non-linear, top and bottom edges extending between said second side edges;

c) said first bottom edge and said second top edge having coextensive first and second portions thereof extending inwardly from opposite ones of said first and second side edges, and respective, non-coextensive, third portions defining a unitary scrap portion;

d) each of said blank layouts having an overall length L between the points on its top and bottom edges which are farthest spaced in a longitudinal direction parallel to said side edges;

e) at least part of each of said first and second portions of said first bottom edge being closer than at least part of said third portion of said second top edge to said second bottom edge, whereby the overall length $L_1$ between the points on said first top edge and said second bottom edge which are farthest spaced in said longitudinal direction is less than 2L.

46. The succession of blank layouts of claim 45 wherein $L_1$ equals approximately 1.85L.

47. The succession of blank layouts of claim 45 wherein the total scrap associated with each of said blank layouts consists of said unitary scrap portion and a pair of identical, discrete scrap portion.

48. The succession of blank layouts of claim 45 wherein the total surface area of scrap associated with each of said blank layouts is approximately 20% of the surface area of one of said blank layouts.

49. The succession of blank layouts of claim 45 wherein each of said blank layouts consist of right and left halves which are mirror images of one another on opposite sides of a centerline parallel to said side edges.

* * * * *